United States Patent [19]

Kondo

[11] 4,147,021

[45] Apr. 3, 1979

[54] ELECTRONIC WATCH HAVING AN ALARM MEANS

[75] Inventor: Kenichi Kondo, Tokyo, Japan

[73] Assignee: Kabushiki Kaisha Daini Seikosha, Japan

[21] Appl. No.: 734,427

[22] Filed: Oct. 21, 1976

[30] Foreign Application Priority Data

Oct. 28, 1975 [JP] Japan ..... 50-129581

[51] Int. Cl.[2] ..... G04B 23/00

[52] U.S. Cl. ..... 58/16 D; 58/38 R; 58/57.5; 58/50 R; 58/152 B

[58] Field of Search ..... 58/23 R, 38 R, 57.5, 58/19 C, 152 B, 152 R

[56] References Cited

U.S. PATENT DOCUMENTS

| | | | |
|---|---|---|---|
| 3,727,395 | 4/1973 | Baylor | 58/19 C |
| 3,813,533 | 5/1974 | Cone et al. | 58/152 R |
| 3,937,004 | 2/1976 | Natori et al. | 58/152 B |
| 3,946,549 | 3/1976 | Cake | 58/57.5 X |

*Primary Examiner*—Ulysses Weldon

*Attorney, Agent, or Firm*—Robert E. Burns; Emmanuel J. Lobato; Bruce L. Adams

[57] ABSTRACT

An electronic watch having an alarm means which produces alarm by sound or color phase when a time count coincides with an alarm setting time. A display device displays for selected alarm channels whether an alarm time is memorized or not, and the watch includes circuitry display setting times when a channel is selected and simultaneously to operate the channel displaying in a turn-on and off lighting mode of operation.

1 Claim, 2 Drawing Figures

ELECTRONIC WATCH HAVING AN ALARM MEANS

BACKGROUND OF THE INVENTION

This invention relates to an electronic watch having an alarm means.

In the conventional type electronic alarm watch, there is required two kinds of setting control circuits. One is used to generate control signals corresponding to days, hours and minutes for modifying time setting and another one is used to generate only control signals corresponding to hours and minutes for modifying alarm setting times.

OBJECT OF THE INVENTION

The present invention aims to eliminate the above noted difficulty and insufficiency, and the object of the present invention is to provide an alarm electronic watch having simplified structure and making common use of circuits by applying one control system for time setting and alarm setting instead of the conventional two kind of control systems.

BRIEF DESCRIPTION OF THE DRAWINGS

The above mentioned and further objects, features and advantages of the present invention will be come more obvious from the following description when taken in connection with the accompanying drawings which show one preferred embodiment of the present invention and wherein.

DESCRIPTION OF THE PREFERRED EMBODIMENT

This invention relates to an electronic watch having an alarm means, especially one which produces alarm by sound or color phase when the contents of a time counter coincides with an alarm setting time, and further having a display device for displaying whether a time set-channel is memorized or not, whereby it is possible to display setting times when said channel is selected and simultaneously to operate turn-on and off of said channel display.

Figure 1:
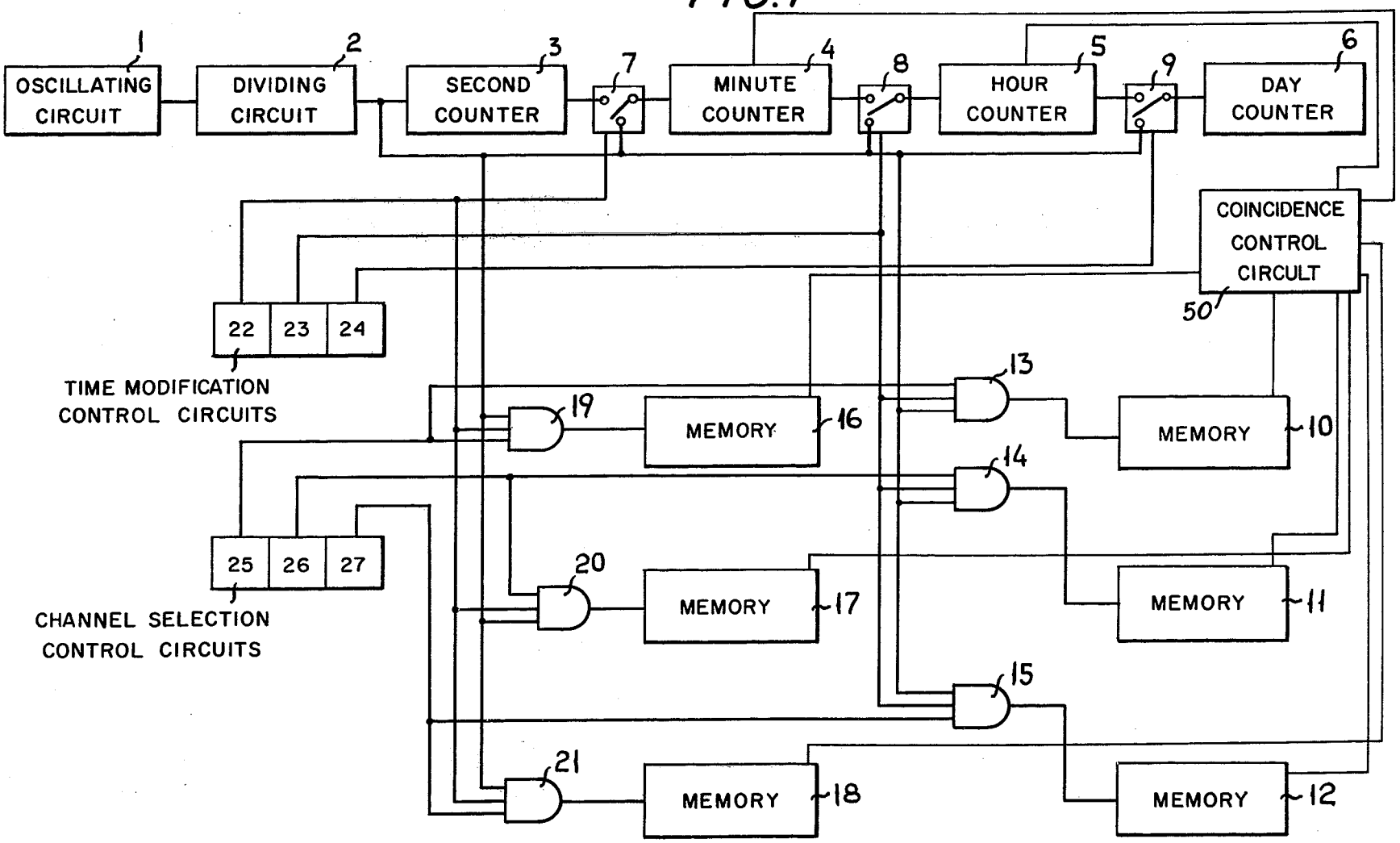
FIG. 1 shows a block diagram of this invention.

Referring now to the embodiment of the present invention illustrated in the accompanying drawings in which:

FIG. 1 shows a logic block diagram. A signal of oscillating circuit (1) having a quartz oscillator is applied to a dividing circuit (2) and then its divided output signal is applied to a second counter (3) for counting seconds. The output of the second, counter is an input to a minute counter (4). The hour counter (5) and a day counter (6) are likewise connected in cascade for counting time. Switch circuits (7), (8) and (9) are controlled by control signals of time modification control circuits (22), (23) and (24) respectively and they are electronic switch circuits made of transmission gates able to perform time modification of 1Hz speed.

Next, selections of channels are conducted by channel selection control circuits (25), (26) and (27) and simultaneously contents of memories are indicated on a display unit. In order to explain the structure of this invention and its operation more specifically, the time setting operation of the No. 1 channel will be described. Memories (16) and (10) which correspond to channel No. 1 are first selected by the selection control circuit

(25). The said memory (16) is a minute counter and the memory (10) is a hour counter. And then hour setting of the time modification is performed by applying the 1Hz signal from the dividing circuit (2) to the hour counter memory (10). After the hour setting has finished, minute setting is performed by the same procedure mentioned above; that is, by selecting the memory (16) with a control signal of the said time modification control circuit (23). AND circuits (19), (20), (21), (13), (14) and (15) each for applying signals to the input gate of a respective memory are used for selecting to which memory the 1Hz signal is applied.

Figure 2:
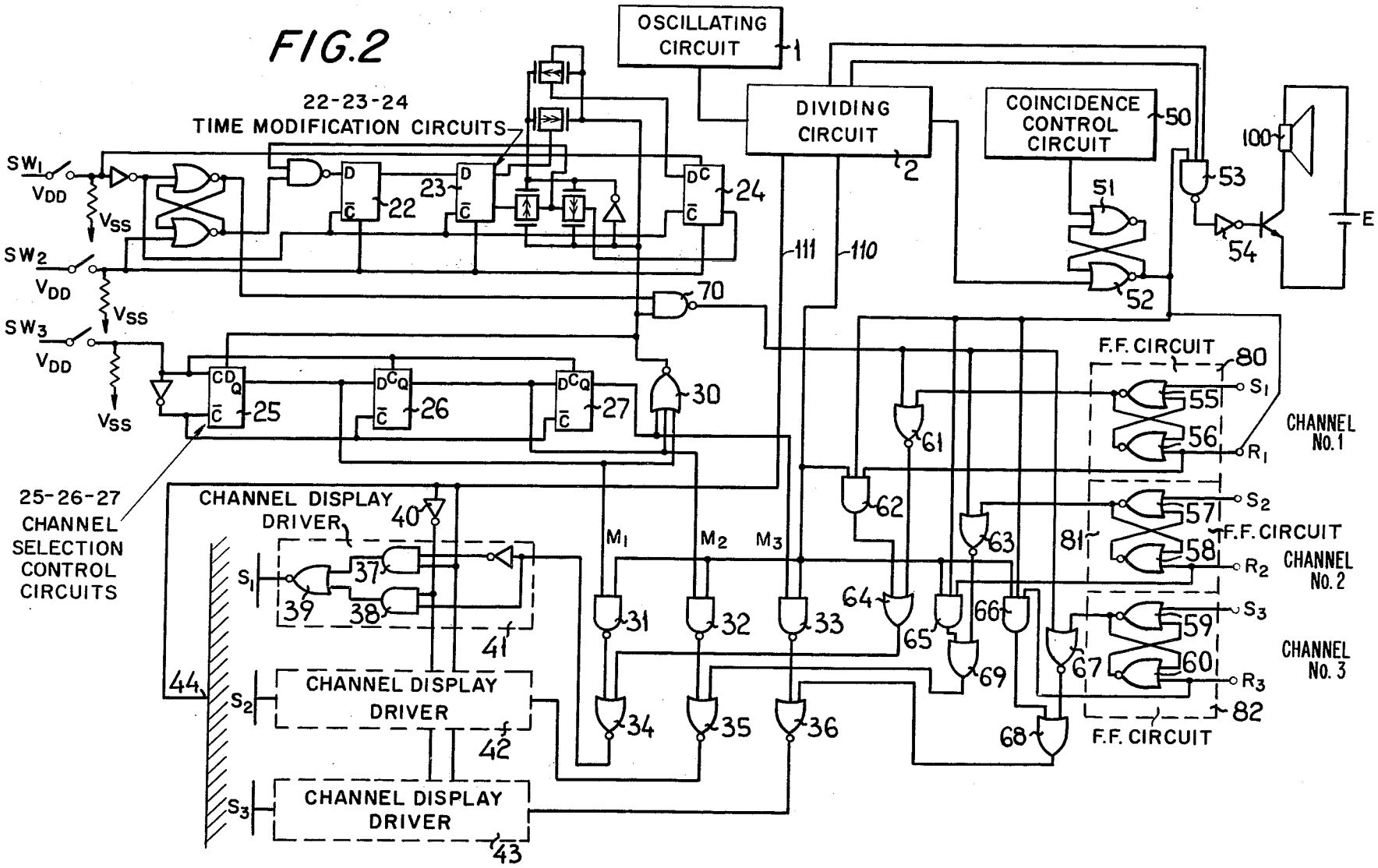
FIG. 2 shows circuit structure of this invention.

Next, the functions of the control circuits will be described in conjunction with the structure illustrated in FIG. 2.

The time modification circuits (22), (23) and (24) are trinary counters comprised of D type flip flops, but when the content of the memory is selected, that is, when one of the channel selection control circuits (25), (26), and (27) is selected, the said trinary counter turns into a binary counter by changing over the function of a transmission gate within the counter and can produce a hour or minute modification signal. The channel selection control circuits (25)–(27) are also D-type flip-flops and thus the outputs of all of the channel selection control circuits for time displaying are "0" level, and accordingly the output of the NOR circuit (30) is "1" level. Therefore the time modification control circuits (22), (23) and (24) cause the transmission gates to open by the output of the said NOR-circuit (30) so as to operate as trinary ring counters.

One pulse signal produced by one push of a channel selection switch $SW_3$ becomes a clock signal for the channel selection control circuit (25) and this input datum is "1" level, so that the output of the channel selection control circuit (25) change to the "1" level and also the contents of the No. 1 channel memories (10) and (16) are displayed. Further, the output of the NOR circuit (30) changes from "1" level to "0" level and thus the said signal causes the time modification control circuits to operate as binary counters. A switch $SW_2$ is a reset switch and also used for a safety switch. When the said switch $SW_2$ is on, days, hours and minutes are displayed on the time display unit and time is being counted.

Next, it will be described that in case of using a liquid crystal digital display unit, the operation of turning on-and-off lighting of the channel display for showing channel content is effected when selection of channels is performed.: Herein is described selection of the content of the No. 1 channel. If the channel selection control circuit (25) is selected by pushing the channel selection switch $SW_3$, the output of the said circuit (25) turns to the "1" level and is applied to a NAND circuit (31). There has been already applied thereto over the signal path (110) another 1Hz signal which is the output of the dividing circuit (2), and therefore the output of the NAND circuit (31) produces a 1 Hz signal but the outputs of the NAND circuits (32) and (33) do not produce a 1 Hz signal. Because the output of the NAND circuit (31) is an input to the NOR circuit (34), the said NOR-circuit (34) produces a 1 Hz output signal which is the inverse of the 1 Hz input signal when another input of the said circuit (34) is "0" level, and then this 1 Hz signal is applied to the channel display driver (41). The channel display drivers (41), (42) and (43) are each comprised of two AND-circuits, one inverter and one NOR-circuit in each driver, and therefore the right and opposite phase signals every second are produced as an output of the NOR circuit (39) and then the said signals are added to the common electrode (44) in order to change the said signals to the display segment $S_1$, and a turn-on-and-off lighting mode of operation every second may be repeated. No display on the other channel display segments $S_2$ and $S_3$ is performed in order to charge the right phase voltage the same as one of the common electrode (44) thereon. The 32 Hz output of the dividing circuit (2) is added to the common electrode (44) over the signal path (111).

Channel indicating circuitry is comprised of set-reset flip-flop circuits (80), (81), and (82) for memorizing the presence of the stored alarm time in every memory channel, NOR circuits (61), (63) and (67), OR-circuits (64), (68) and (69), and three input AND circuits (62), (65) and (66). To simplify the description, operation of the No. 1 channel only is considered. Similar operations are performed for the other channels.

At first, when the safety switch $SW_2$ is on, none of the memories for days, hours and minutes displays are selected, so that output of the NAND circuit (70) is "0" level. And when there is no content of the No. 1 channel memories, that is, the R-S flip-flop circuit (80) is reset, the output of the NOR circuit (55) is "1" level and then the NOR circuit (61) output is "0" level which becomes an input to the OR circuit (64). Another input of the said OR circuit (64) is the output of the AND circuit (62) and input signals applied to the said AND circuit (62) are the 1 Hz signal of the dividing circuit (2) and the output of the NOR-circuit (52) comprising an R-S flip-flop together with NOR circuit (51). When there is no coincidence, the output of the NOR circuit (51) is "0" status and the output of NOR circuit 52 is "1." Therefore, the output of the AND circuit (62) is "1" level and accordingly the output of the OR circuit (64) is "0" level. Therefore channel display is not performed.

Next the case where there are some stored memory contents in the No. 1 channel will be described. The clock pulse used to set the No. 1 channel is also an input to the set-input terminal $S_1$ of the R-S flip-flop (80), therefore the output of the NOR circuit (55) turns to "0" level because of the presence of stored memory content. Accordingly the output of the OR circuit (64) turns to "1" level and the channel display of the No. 1 channel changes to a continually illuminated condition. These upon, when an alarm setting time coincides with current or present time, a coincidence signal produced by the coincidence control circuit (50) is applied to the NOR circuit (51) and then the output of the NOR circuit (52) turns to "1" level. By the coincidence, the above mentioned output of the NOR-circuit (52) resets the No. 1 channel memory for clearing its content and also the reset signal is input to the NOR circuit (56), so that output of the NOR circuit (55) turns again to "1" level. Accordingly the output of the NOR circuit (61) turns to "0" level and becomes an input of the OR circuit (64). Reset input of the NOR circuit (56) is also an input of the AND circuit (62), so that the output of the said AND circuit (62) can produce a 1 Hz signal only when the output of the NOR circuit (52) is "1" level and consequently the No. 1 channel display operates in a turn-on-and-off lighting mode of operation. The time range of the said turn-on-and-off display mode is determined according to the short pulse signal formed by the latch circuit and the signal from the second counter applied at a specified period to the NOR circuit (52). The said on-and-off cycle is repeated and terminates the channel display together with stopping of the alarm sound by being reset. The buzzer (100) is driven by applying a comparatively high frequency of the dividing circuit and a lower frequency such as some 16 Hz to the NAND circuit (53).

As mentioned above, the present invention makes common use of the time modification control system in the time counting unit and the selection control system for setting hours and minutes of the alarm, and makes it easy to handle by unifying the switch operations for users.

Further, when the specified channel is selected, the corresponding channel display operates in a turn-on-and-off lighting mode of operation, therefore a user is more effectively alerted than with the normal invariable channel display in a digital alarm electronic watch. Next, if when a time counting signal coincides with the alarm setting time in the selected channel, the corresponding channel display begin to repeat the on-off-lighting mode of operation and ends by extinguishing its display light at the same time of stopping an alarm buzzer sound, so it is in the normal condition:- that is, while hours and minutes are displayed such channel displays perform on-off lighting operation at the time of producing the alarm. Therefore it can clearly notify what channel alarm setting time it is and a user is easily reminded of the reason for the set alarm time. So that these functions give a great convenience to a user.

What we claimed is:

1. An electronic alarm watch, comprising: an oscillator circuit for generating an oscillating time standard signal; a dividing circuit connected to receive the oscillating time standard signal for dividing the same and for developing a repetitive timing signal having a repetition rate defining a unit of time; a counter circuit connected to receive the timing signal for counting the same and for developing a count representative of time; memory means having a plurality of channels for memorizing a plurality of alarm times; coincidence detecting means cooperative with said counter circuit and said memory means for detecting coincidence between the time represented by the count developed by said counter circuit and said plurality of alarm times and for developing a coincidence signal indicative of the detected coincidence; a plurality of displays each corresponding to a respective memory channel and each having a driving circuit for driving the associated display, wherein each of said display driving circuits includes a two-input NOR circuit for developing an output signal for driving the associated display, a pair of two-input AND circuits each having an output terminal connected to a respective input of said NOR circuit, and an inverter connected to one input of one of said AND circuits; channel selecting means for selecting a respective memory channel for comparison with the contents of said counter circuit; means cooperative with said channel selecting means and said coincidence detecting means for applying the coincidence signal and the inverse of the coincidence signal each to an input of a respective one of said AND circuits in the one of said driving circuits corresponding to the selected memory channel; and means for applying the timing signal to said inverter and the remaining input terminal of said AND circuits in said one of said driving circuits, whereby the memory display corresponding to a selected memory channel will flash on and off at a rate determined by said timing signal when the alarm time of the selected memory channel occurs.

* * * * *